US007267590B1

(12) United States Patent
Jones et al.

(10) Patent No.: US 7,267,590 B1
(45) Date of Patent: Sep. 11, 2007

(54) RECREATIONAL BOAT HAVING TWIN ELECTRIC TROLLING MOTORS

(75) Inventors: Frank W. Jones, Willow Spring, NC (US); Warren D. Lee, Dunn, NC (US)

(73) Assignee: Twin Troller Boats, Inc., Benson, NC (US)

( * ) Notice: Subject to any disclaimer, the term of this patent is extended or adjusted under 35 U.S.C. 154(b) by 0 days.

(21) Appl. No.: 11/484,274

(22) Filed: Jul. 11, 2006

(51) Int. Cl.
*B63H 5/16* (2006.01)

(52) U.S. Cl. ..... 440/69; 440/6

(58) Field of Classification Search ..... 440/6, 440/67–70
See application file for complete search history.

(56) References Cited

U.S. PATENT DOCUMENTS 3,848,561 A * 11/1974 Price ..... 440/69
4,537,144 A * 8/1985 Horton ..... 114/61.24
4,730,571 A * 3/1988 Hedlund et al. ..... 114/61.24
5,131,875 A 7/1992 Lee
6,416,368 B1 * 7/2002 Griffith et al. ..... 440/6

* cited by examiner

*Primary Examiner*—Ed Swinehart
(74) *Attorney, Agent, or Firm*—Coats & Bennett, P.L.L.C.

(57) ABSTRACT

A recreational boat comprising a boat hull having a bottom and a top deck. Formed in the bottom are two spaced apart elongated cavities that extend substantially the entire length of the boat. Disposed in each cavity intermediately between the front and rear of the boat is an electric trolling motor. Each electric trolling motor is independently controlled by a foot pedal mounted on the top deck. Hence, the boat is propelled by the trolling motor and can be steered by independently controlling each of the electric trolling motors.

18 Claims, 2 Drawing Sheets

RECREATIONAL BOAT HAVING TWIN ELECTRIC TROLLING MOTORS

The present invention relates to small watercrafts, and more particularly to watercrafts that are powered, in part at least, by electric trolling motors.

BACKGROUND OF THE INVENTION

Small boats that employ electric trolling motors are known and are typically used on lakes and ponds for recreation and fishing. They are popular for a number of reasons. They are relatively small, lightweight, easy to handle and maneuver and can be enjoyed by adults and children alike.

However, many trolling motor boats of this type do not integrate the trolling motors into the hull of the boat. Instead, trolling motors are attached to an exterior portion of the boat and because of that the trolling motors appear to be, and often are, add-ons. This means that the trolling motors may hang from the side of the boat and impair the boat's ability to be maneuvered through close quarters. Further, if the boat is transported from one lake to another, the trolling motors may have to be removed and replaced. In addition, security may be an issue if the boat with the trolling motors mounted thereon is left unattended.

Therefore, there has been and continues to be a need for a small, recreational boat that utilizes electric trolling motors where the trolling motors are integrated into the hull of the boat.

SUMMARY

The present invention relates to a small boat or watercraft that is powered by two electric trolling motors integrated into the hull of the boat.

In one particular embodiment of the present invention, the boat hull is provided with a pair of spaced apart elongated cavities that are formed in the bottom of the boat hull. Disposed in each of these cavities is an electric trolling motor that is controlled from an upper deck area of the boat.

Other objects and advantages of the present invention will become apparent and obvious from a study of the following description and the accompanying drawings which are merely illustrative of such invention.

DESCRIPTION OF EXEMPLARY EMBODIMENT

Figure 1:
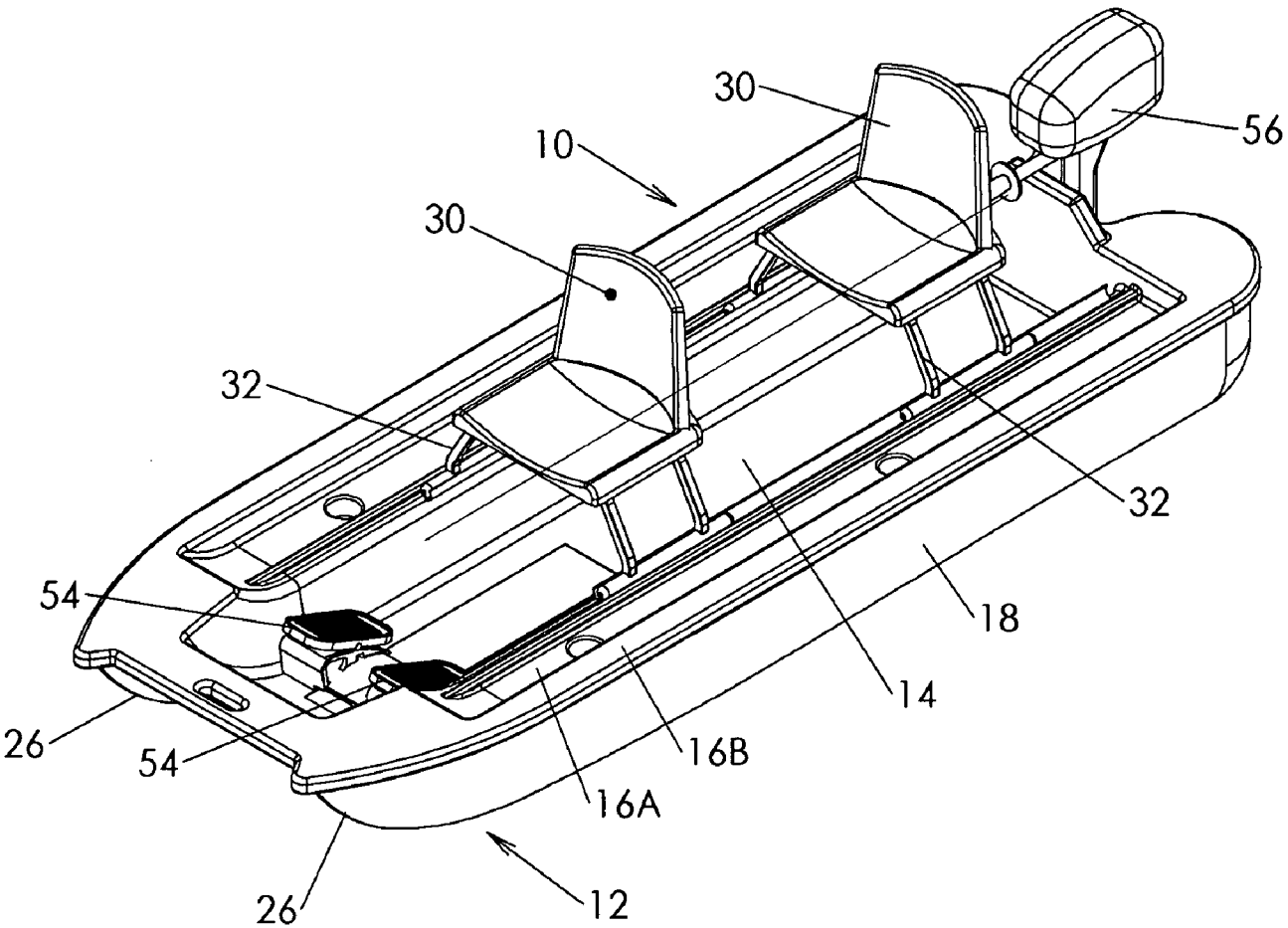
FIG. 1 is a perspective view of the trolling boat of the present invention.

With further reference to the drawings, the trolling boat of the present invention is shown therein and indicated generally by the numeral 10. As will be appreciated from subsequent portions of this disclosure, trolling boat 10 is a relatively small and highly maneuverable water craft that is particularly useful as a recreational boat on ponds and lakes. Viewing trolling boat 10 in more detail, the trolling boat 10 includes a hull indicated generally by the numeral 12. The hull 12 includes a top, bottom, sides and front and rear areas.

While the hull 12 can be manufactured from various materials utilizing various processes, it is contemplated that in one embodiment, the hull 12 would be constructed of high density polyethylene through a rotational molding or vacuum molding process.

Viewing hull 12 in more detail, it is seen that the same includes a top deck. The top deck includes multi levels. As seen in the drawings, forming a part of the top deck is a central sunken section or portion 14. This section of the top deck extends substantially the length of the hull 12. Stepped up from the central sunken section 14 is an outer raised portion. In the particular embodiment disclosed herein, the outer raised portion includes an outer perimeter portion 16B that extends around the hull 12. Just inwardly of the outer raised portion 16B is an area designated by 16A. Area 16A is stepped up from the central sunken portion 14 but is disposed just below the level of outer portion 16B.

Figure 3:
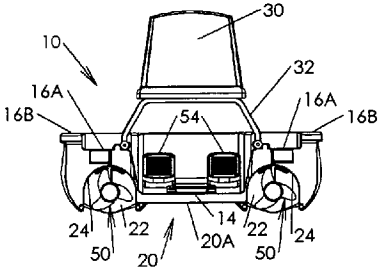
FIG. 3 is a cross sectional view of the boat taken along the line 3—3 of FIG. 2.
Figure 2:
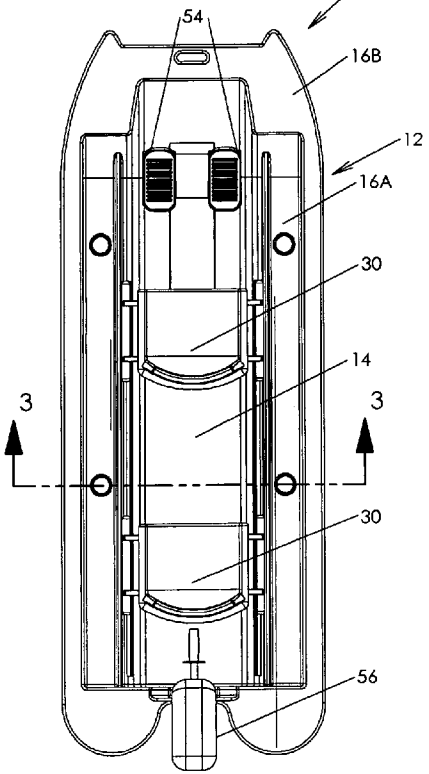
FIG. 2 is a top plan view of the boat.
Figure 4:
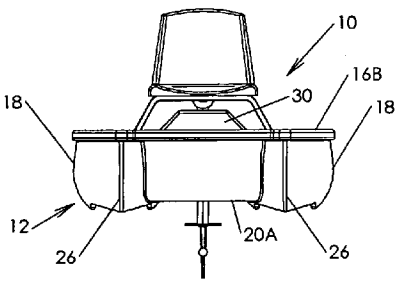
FIG. 4 is a front elevational view of the boat.

Hull 12 includes a pair of opposed side walls 18 and a bottom indicated generally by the numeral 20. See FIG. 3. Bottom 20 includes a central portion 20A. Formed in the bottom 20 is a pair of spaced apart cavities 22. Cavities 22 are formed by a cavity wall 24 that forms a part of the bottom 20 of the hull 12. As seen in FIG. 3, the two cavities 22 are spaced apart and disposed just outwardly of the central bottom portion 20A. Each cavity 22 is elongated and extends a substantial length along the hull 12. Each cavity 22 is open at the bottom and back, but is generally closed at the front. As noted in FIG. 3, each cavity 22 and its surrounding wall structure 24 assumes a generally inverted U shape with the top portion of the cavity 22 being generally curved or cylindrically shaped. Cavity 22 may assume other forms or configurations. For example, the front of the cavity 22 could be open. In a configuration where the front of the cavity 22 is open, the bottom of the cavity 22 could be closed so as to define an elongated front-to-back opening in the hull and through which water would pass as the boat is propelled through the water.

As noted above, the front portions of each cavity 22 is generally closed. As seen in FIG. 1, the front or bow portion of the boat 10 includes a pair of keels 26. Keels 26 form a point and function to cut through the water as the trolling boat 10 is propelled, generally preventing splashing. Each keel 26 is generally aligned with a respective cavity 22. In one embodiment or design, the front of the cavity 22 is closed and because of the structure of the hull, and how the front portions of the cavities 22 are closed, the hull structure is overlapped at the keels 26. This feature imparts strength and rigidity to the keels 26.

Mounted on the top deck of the boat 10 is one or more seats 30. Each seat 30 includes a seat frame 36 that transversely spans the central sunken section 14 of the hull 12. In the case of the present embodiment, the seat frame 32 includes a pair of curved arms that extend from each side of the seat 30 and attach to a runner that is retained within a longitudinal groove or slot formed in a portion of the top deck of the boat. Preferably the one or more seats 30 can be adjusted fore and aftly along the top deck. Seat 30 and seat frame 32 would be provided with a releasable locking mechanism that would permit the seat frame 32 to be adjusted to a particular position with respect to the top deck of the boat.

Mounted in each cavity 22 is an electric trolling motor indicated generally by the numeral 50. This is particularly illustrated in FIG. 3. Details of the electric trolling motors 50 are not dealt with herein because such is not per se material to the present invention, and further electric trolling motors are well known in the art. In any event, each electric trolling motor 50 includes an electric motor and a propeller, both of which are disposed in a respective cavity 22. To support the trolling motors 50 within the cavities 22, each trolling motor 50 is provided with a support shaft 52 that suspends the trolling motor 50 at an appropriate elevation within a respective cavity 22. More particularly, the support shaft 52 supports the electric motor and propeller of each trolling motor 50 in a fixed location within one of the cavities 22. The electric motor and propeller that form each trolling motor 50 is longitudinally aligned with a cavity 22. As seen in FIG. 3, the wall 24 of the cavity 22 substantially encompasses and extends around each trolling motor 50. Although the bottom of the cavity 22 is open, in the embodiment illustrated in FIG. 3, the wall 24 of the cavity 22 surrounds the opposed sides and top of the trolling motor 50 mounted therein. Because the trolling motors 50 are powered by battery, there are provisions for directing wiring from the controls through the hull to each of the trolling motors 50. Also, the motors 50 are mounted intermediately in the cavities 22 such that water can enter from the front and back of the motors 50. When the motors 50 are operating in a "forward" direction, water will enter from the front of the motor, and when the motors 50 are operating in "reverse," water will enter from the rear of the motors 50.

As noted above, the trolling motors 50 disclosed in this embodiment are electric trolling motors. Hence, they are powered by a battery (not shown). In order to control both the propulsion and steering of the boat 10, there is provided a pair of foot pedals 54. Foot pedals 54 are disposed on the central sunken portion 14 of the top deck and would be adjustable both laterally and longitudinally. Each pedal would control one of the electric trolling motors 50. There would be both a forward and reverse control, and the foot pedals 54 would provide variable speed control in both forward and reverse directions. Details of the controls are not dealt with herein because such is not per se material to the present invention and such controls are known in the art. For a more unified and complete understanding of one type of control system for a small electric trolling motor boat, one is referred to the disclosure found in U.S. Pat. No. 5,131,875, which is expressly incorporated herein by reference.

As an option, the boat 10 of the present invention is provided about the stern with a mount for receiving and supporting a gasoline engine denoted by the numeral 56. Preferably, the mount for mounting the optional gasoline engine 56 is integrated into the hull 12. In certain cases, it might be desirable to mount a gasoline engine to the boat in order to provide additional power and speed.

As appreciated from the foregoing discussion, it is seen that the trolling boat 10 of the present invention is of a simple and compact design that is highly maneuverable. By strategically placing the electric trolling motors 50 inboard the sides 18 and in the cavities 22, the boat becomes sleek and streamlined with its twin trolling motors 50 basically confined interiorly of the exterior portions of the hull 12. This enables the boat 10 to be easily transported and handled, and eliminates the need to disconnect and connect trolling motors each time the boat is transported from one lake or pond to another.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A recreational trolling boat, comprising:

a. a molded hull having opposed sides, front, rear and bottom;

b. the hull including a top deck having an elongated central sunken portion and at least one outer raised portion disposed on each side of the sunken portion;

c. the central sunken portion including a forward end portion and a rear end portion;

e. a pair of spaced apart elongated cavities formed in the bottom of the hull with each cavity being spaced inwardly from an adjacent side of the hull and open from the bottom;

d. the central sunken portion being disposed at a level below a top portion of the pair of cavities such that the central sunken portion extends through a substantial length of the boat and extends generally between the pair of cavities;

f. an electric trolling motor mounted in each cavity intermediately between the front and rear of the hull;

g. a pair of foot pedals disposed in the elongated central sunken portion with each pedal operative to control one of the electric trolling motors wherein each electric trolling motor is independently controlled to propel and steer the boat;

h. one or more seats spaced above the top deck and central sunken portion of the top desk; and g. each seat having a frame structure that extends over and spans the central sunken portion of the top deck and which is supported by the outer raised portion of the top deck.

2. The recreational trolling boat of claim 1 wherein each cavity includes a generally inverted U-shaped wall.

3. The recreational trolling boat of claim 1 wherein each electric trolling motor includes a motor and a propeller and wherein each cavity extends substantially around the motor and propeller of each trolling motor.

4. The recreational trolling boat of claim 1 wherein each cavity includes a front portion and a rear portion and wherein the front portion of each cavity is generally closed and the rear portion of each cavity is generally open.

5. The recreational trolling boat of claim 1 wherein each cavity includes a surrounding wall and wherein each trolling motor includes a support shaft that extends through the wall of the adjacent cavity.

6. The recreational trolling boat of claim 1 including a gasoline engine mounted to the rear of the boat.

7. The recreational trolling boat of claim 1 wherein each side of the hull includes a side wall that extends downwardly and curves generally inwardly, and thereafter joins a portion of a respective cavity.

8. The recreational trolling boat of claim 7 wherein there is defined an open space between each side wall of the hull and a substantial portion of a wall that forms a part of an adjacent cavity.

9. The recreational trolling boat of claim 1 wherein the at least one raised portion of the top deck includes a first raised portion that is contiguous with the central sunken portion and extends outwardly from the central sunken portion, and a second raised portion that is raised with respect to both the central sunken portion and the first raised portion and which forms an outer portion of the top deck.

10. The recreational trolling boat of claim 9 wherein the second raised portion includes a pair of rear areas that project from the boat and which are at least slightly curved.

11. The recreational trolling boat of claim 1 wherein the one or more seats are adjustable fore and aptly over the central sunken portion of the top deck.

12. The recreational trolling boat of claim 11 wherein each seat includes a pair of spaced apart runners with each runner being supported on a portion of the top deck outwardly from the central sunken portion of the top deck.

13. The recreational trolling boat of claim 12 wherein there is provided a pair of spaced apart elongated grooves formed in the top deck outwardly of the central sunken portion and wherein the runners are retained in the grooves such that the one or more seats can be adjusted fore and aptly over the central sunken portion of the top deck.

14. The recreational trolling boat of claim 13 wherein there is provided a pair of longitudinally spaced seats and wherein each seat includes a frame that spans the central sunken portion of the top deck.

15. The recreational trolling boat of claim 1 wherein the one or more seats are disposed over and aligned with the central sunken portion of the top deck such that the central sunken portion forms an area for receiving the feet of one or more occupants seated on the one or more seats of the boat.

16. A recreational trolling boat, comprising:

a. a molded hull having opposed sides, front, rear, bottom and a top deck;

b. a pair of spaced apart elongated cavities formed in the bottom of the hull with each cavity being spaced inwardly from an adjacent side of the hull;

c. a pair of electric trolling motors, each electric trolling motor mounted in one of the cavities intermediately between the front and rear of the hull;

d. the top deck including an elongated sunken channel formed in the top deck, the central sunken portion being disposed at a level below a top portion of the pair of cavities;

e. the elongated sunken channel having a floor and a pair of sidewalls and extending a substantial distance between the front and rear of the hull;

f. wherein the elongated sunken channel is disposed generally centrally between the opposite sides of the boat and extends generally fore and aptly between the pair of cavities;

g. one or more seats aligned with the sunken channel and spaced over the top deck and the sunken channel; and h. a pair of foot pedal controls disposed in the elongated sunken channel with each foot pedal operative to control one of the electric trolling motors, wherein each electric trolling motor is independently controlled to propel and steer the boat.

17. The recreational trolling boat of claim 16 wherein each seat includes a frame structure that straddles the sunken channel and extends transversely over the sunken channel, and wherein the frame structure of each seat is supported on the top deck outwardly of the sunken channel.

18. The recreational trolling boat of claim 17 wherein the one or more seats are adjustable fore and aptly over the sunken channel and wherein the frame structure of each seat includes an elongated runner confined in the top deck outwardly of the sunken channel such that the runner can move back and forth on the top deck outwardly of the sunken channel.

* * * * *